United States Patent [19]

Thakur

[11] Patent Number: 4,483,238

[45] Date of Patent: Nov. 20, 1984

[54] DUST CONTROL IN LONGWALL MINING

[75] Inventor: Pramod C. Thakur, Morgantown, W. Va.

[73] Assignee: Conoco Inc., Ponca City, Okla.

[21] Appl. No.: 432,202

[22] Filed: Oct. 1, 1982

[51] Int. Cl.[3] ..... E21F 1/00

[52] U.S. Cl. ..... 98/50; 299/19

[58] Field of Search ..... 98/50; 299/12, 19

[56] References Cited

U.S. PATENT DOCUMENTS

| | | | |
|---|---|---|---|
| 925,274 | 6/1909 | Belloni | 98/50 |
| 2,859,682 | 11/1958 | Joy | 98/50 |
| 3,455,606 | 7/1969 | Fischer et al. | 299/19 X |
| 3,695,714 | 10/1972 | Thompson | 98/50 X |
| 4,196,933 | 4/1980 | Nakigima et al. | 299/11 |

FOREIGN PATENT DOCUMENTS

| | | | |
|---|---|---|---|
| 693012 | 10/1979 | U.S.S.R. | 299/19 |
| 717335 | 2/1980 | U.S.S.R. | 299/19 |
| 729350 | 5/1980 | U.S.S.R. | 299/19 |

*Primary Examiner*—Harold Joyce

*Attorney, Agent, or Firm*—Richard W. Collins

[57] ABSTRACT

Boreholes are drilled at an angle from gate roads to the working face in a longwall mining operation, and air is exhausted from the working face area through the boreholes. Additional boreholes, parallel to the first boreholes, are drilled from the gate roads into the longwall pillar, and as the face moves through the pillar it intersects the additional boreholes, and dust-laden air is exhausted through the additional boreholes.

5 Claims, 1 Drawing Figure

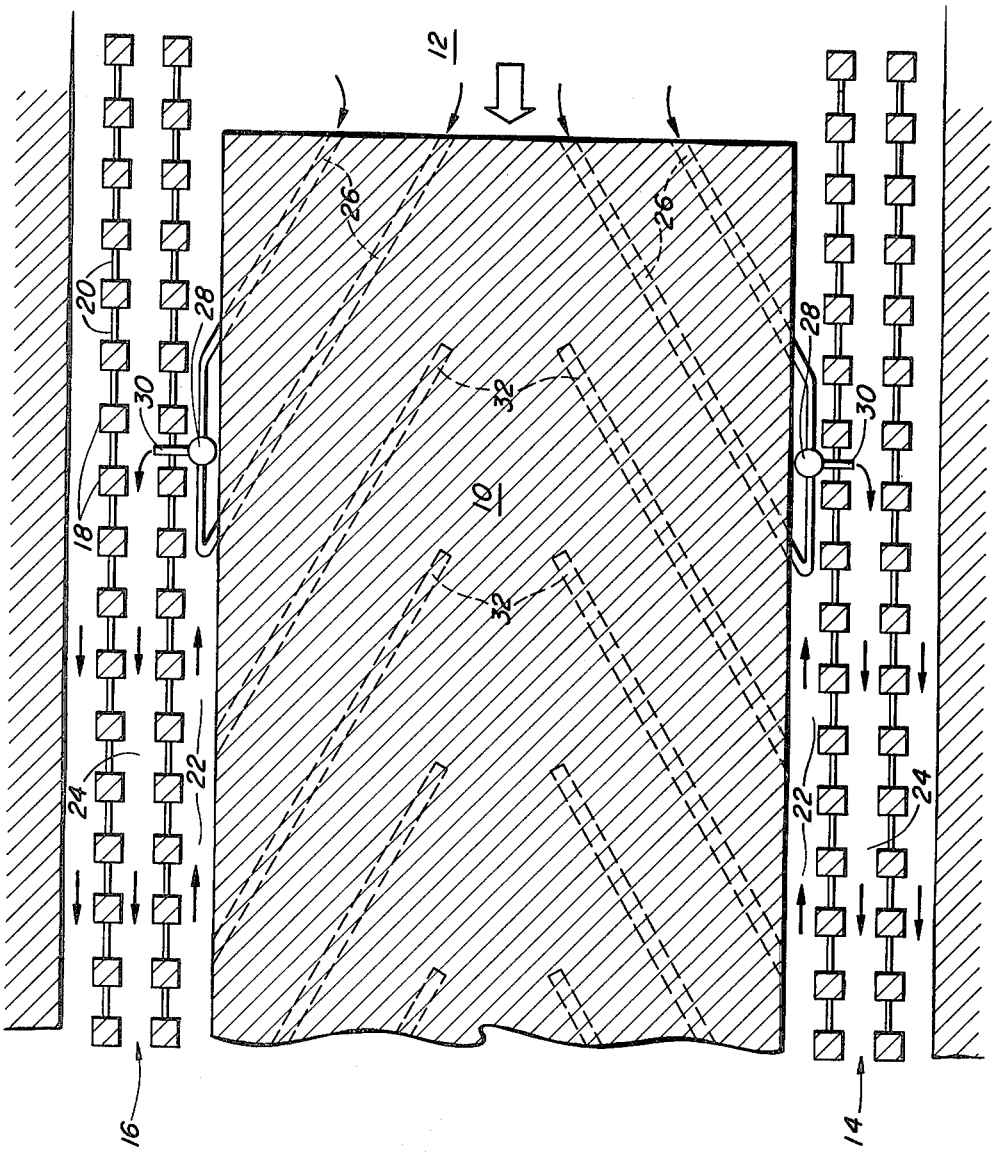
12
26
26
20
28
28
30
30
32
32
10
18
22
22
24
24
16
14

DUST CONTROL IN LONGWALL MINING

BACKGROUND OF THE INVENTION

1. Field of the Invention

This invention relates to longwall coal mining operations, and more particularly to a method of controlling dust around the working face of a longwall mining operation.

2. The Prior Art

Longwall mining is a relatively recently developed technique of mining coal in which a coal seam is developed by driving a series of entries or gate roads through the coal seam to create large generally rectangular longwall pillars which are then mined by a longwall mining machine which traverses a working face extending at right angles to a pair of parallel gate roads. As the mining machine moves through the coal pillar, a row of roof supports is advanced along with the mining machine and its associated cut coal conveyor. Longwall mining is now a well developed and widely used coal mining technique.

One of the problems associated with longwall mining is the generation of large amounts of dust around the working face. This invention is directed to a novel process for reducing the dust level around the working face of a longwall mining operation.

Longwall mining is described in some detail in U.S. Pat. No. 4,196,933, although that patent does not discuss the problem of dust in the working face area.

One prior art approach to controlling dust has been to use spray fans to knock down dust in the air. While successful to some extent, these spray fans create additional operating problems in some cases.

An early version of longwall mining, not widely practiced today, is described in U.S. Pat. No. 2,859,682. In that method, a bore miner produces large bores parallel to the longwall face, and a coal cutting machine then cuts the coal between the bore and the face. Modern longwall mining utilizes the equipment and technique described in U.S. Pat. No. 4,196,933 rather than that described in U.S. Pat. No. 2,859,682.

The mining process described in U.S. Pat. No. 2,859,682 is, however, pertinent to the present invention in that it describes a method of ventilating the working area by flow of air from one gate road through holes in the coal pillar and out another gate road. However, the requirement in U.S. Pat. No. 2,859,682 of bores or tunnels large enough to enter and form smaller cross bores connecting the large bore with the working area is not practical in most cases, and there has been a need for an improved method of controlling dust in the working face area of a longwall mining operation. Such a method is provided by the present invention.

SUMMARY OF THE INVENTION

According to the present invention, ventilation boreholes are drilled from gate roads through a longwall coal pillar to the working face area, and dust-laden air is exhausted from the working face area through the boreholes. Additional boreholes parallel to the original boreholes are drilled into the coal pillar, and as the working face moves through the coal pillar it intersects these additional boreholes, at which time dust-laden air is then withdrawn through the additional boreholes.

DESCRIPTION OF THE DRAWINGS

The FIGURE is a horizontal sectional view showing the improved dust control method of the invention.

DESCRIPTION OF THE PREFERRED EMBODIMENT

The preferred embodiment of the invention will be described with reference to the drawing in which a longwall coal pillar 10 is shown bounded at one end by working face area 12 and on parallel sides by gate roads 14 and 16. Each of the gate roads includes a series of chain pillars 18 connected by stoppings 20 forming air flow passages. Each of roads 14 and 16 include an intake airway 22 and exhaust airway 24. Airways 22 and 24 also are used for transport of men, equipment, and cut coal as is conventional.

A plurality of boreholes 26 are drilled from intake airways 22 through coal pillar 10 to working face area 12. Exhaust fans 28 are connected by ducting to boreholes 26, and exhaust conduit 30 extends from fans 28 through a stopping 20 into exhaust airway 24.

Boreholes 26 may be of any practical diameter, but for good ventilation and ease of drilling they are preferably from 10 to 30 centimeters in diameter. Boreholes 26 may be at any effective angle to the working face, but generally are at an angle of between 30 and 60 degrees to the face, and most preferably from 40 to 45 degrees. Any number of boreholes may be formed, but preferably they are spaced from 25 to 40 meters apart along the intake airways 22.

Additional boreholes 32 are drilled parallel to boreholes 26 from intake airways 22 into coal pillar 10. These additional boreholes preferably extend from intake airways 22 into coal pillar 10 to a point approximately midway between gate roads 14 and 16. It will be apparent that as the working face moves through coal pillar 10 the boreholes 26 will disappear, and additional boreholes 32 will be intersected by the moving face. As this occurs, exhaust fans 28 will be successively removed from the disappearing boreholes and connected to boreholes newly intersected by the moving face, such that at all times dust laden air from the working face area will be exhausted through the boreholes that are intersected by the working face and connected to the exhaust fans.

Air flow in accordance with the invention is as indicated by the arrows in the drawing, moving from intake airways 22 to the end of coal pillar 10 along the working face, out the appropriate boreholes, through exhaust fans 28 and into exhaust airways 24.

In addition to controlling dust in the working face area, the method of invention serves to remove methane gas from coal pillar 10, further improving safety.

It will be apparent to those skilled in the art that numerous variations and modifications to the preferred embodiment as described in detail above could be made without departing from the true scope of the invention, which is defined in the appended claims.

I claim:

1. A method of controlling dust at the working face area of a longwall coal mining operation comprising:

(a) drilling a plurality of boreholes through a longwall pillar, said boreholes extending from a gate road to the face of said pillar and intersecting said face at an angle of from 30 to 60 degrees;

(b) attaching air withdrawal means to said plurality of boreholes and drawing dust-laden air through said boreholes from the face area and exhausting said dust-leaden air from said boreholes;

(c) drilling additional boreholes from a gate road into said pillar at an angle to the face of said pillar, said additional boreholes being more remote from said face than said plurality of boreholes such that said additional boreholes intersect said face as it moves through said pillar; and (d) as said face advances through said pillar, disconnecting said air withdrawal means from said plurality of boreholes, and connecting said air withdrawal means to said additional boreholes.

2. A method of controlling dust at the face area of a longwall mining operation comprising:

(a) drilling a plurality of boreholes through a longwall pillar from a first gate road to the face of said longwall pillar, said boreholes beng drilled at an angle to said face;

(b) drilling a plurality of boreholes through said longwall pillar from a second gate road to the face of said longwall pillar, said boreholes being drilled at an angle to said face;

(c) drilling additional boreholes from said first gate road parallel to said plurality of boreholes drilled from said first gate road, and drilling additional boreholes from said second gate road parallel to said plurality of boreholes drilled from said second gate road, said additional boreholes from said first gate road and from said second gate road terminating in said longwall pillar short of said face of said longwall pillar;

(d) attaching air withdrawal means to said plurality of boreholes and drawing dust-laden air through said plurality of boreholes from the face area and exhausting said dust-laden air from said plurality of boreholes; and (e) as said face area advances through said pillar, removing said air withdrawal means from said plurality of boreholes and connecting said air withdrawal means to said additional boreholes.

3. The method of claim 2 wherein all of said boreholes are drilled at an angle of from 30 to 60 degrees to said face, and said air is exhausted into a return airway.

4. The method of claim 3 wherein said additional boreholes are drilled into said longwall pillar to a point approximately midway between said first gate road and said second gate road.

5. The method of claim 3 wherein said boreholes are spaced at intervals of from 25 to 40 meters.

* * * * *